US005287689A

United States Patent [19]

Stahlecker

[11] Patent Number: 5,287,689

[45] Date of Patent: Feb. 22, 1994

[54] SPINNING OR TWISTING SPINDLE ASSEMBLY FOR SECURING A SPINDLE TOP PART IN AN AXIAL DIRECTION

[75] Inventor: Gerd Stahlecker, Eislingen/Fils, Fed. Rep. of Germany

[73] Assignees: Fritz Stahlecker; Hans Stahlecker, Fed. Rep. of Germany

[21] Appl. No.: 926,639

[22] Filed: Aug. 10, 1992

[30] Foreign Application Priority Data

Aug. 10, 1991 [DE] Fed. Rep. of Germany ..... 4126930

[51] Int. Cl.[5] ..... D01H 7/14

[52] U.S. Cl. ..... 57/132

[58] Field of Search ..... 57/130, 131, 132, 133, 57/134, 135

[56] References Cited

U.S. PATENT DOCUMENTS

| | | | |
|---|---|---|---|
| 3,028,721 | 4/1962 | Keyser | 57/132 |
| 3,299,625 | 1/1967 | Beerli | 57/132 |
| 3,447,305 | 6/1969 | Stahlecker et al. | 57/132 |

FOREIGN PATENT DOCUMENTS

| | | | |
|---|---|---|---|
| 1086604 | 8/1960 | Fed. Rep. of Germany | 57/132 |
| 1149652 | 5/1963 | Fed. Rep. of Germany . | |
| 3905533 | 8/1990 | Fed. Rep. of Germany | 57/132 |

*Primary Examiner*—Joseph J. Hail, III

*Attorney, Agent, or Firm*—Evenson, McKeown, Edwards & Lenahan

[57] ABSTRACT

For the axial securing of a spindle top part with respect to a spindle housing, it is known to provide the interior wall of the wharve bore with a collar which is in a detachable form closure with an elastic ring which is fixed on a front-face cover of the spindle housing. According to the invention, for the axial securing of the spindle top part, a retaining element is fixed on a sleeve which is fastened to an outer circumference of the spindle housing and projects beyond its top end face. When the spindle top part 2 is pulled off, such an internal securing arrangement prevents impairments which have a negative effect on the bearing seat of the upper bearing.

15 Claims, 2 Drawing Sheets

SPINNING OR TWISTING SPINDLE ASSEMBLY FOR SECURING A SPINDLE TOP PART IN AN AXIAL DIRECTION

BACKGROUND AND SUMMARY OF THE INVENTION

This invention relates to a spinning or twisting spindle, comprising a spindle top part which is secured in the axial direction against a lifting-out from a spindle housing by means of a first retaining element which is arranged on an interior wall of a wharve bore and is in a detachable form closure with a second retaining element which is arranged on the upper front end of the spindle housing.

In the case of conventional spindles, which are driven by a tangential belt resting against the wharve, the spindle top part, together with the shaft, can be pulled out of the spindle housing in the upward direction. In order to avoid the unintended lifting-off of the spindle top part, mechanically acting securing arrangements of various types are provided for the fixing of the spindle top part on the spindle housing. One of these securing possibilities consists of providing an elastic ring in the area of the end face of the spindle housing, which elastic ring interacts with a collar on the interior wall of the wharve. Such a securing arrangement is called an internal securing arrangement.

In the case of a spinning or twisting spindle of the above-mentioned type known from the German Patent Document DE-AS 11 49 652, an elastic ring is fixed to the end-face cover of the spindle housing and interacts with a ring groove arranged on the interior wall of the wharve bore. In this case, the elastic ring is accommodated by a groove which is machined into the end-face cover. The end-face cover has an axial lengthening which starts out from the end face of the spindle housing and is bounded by ring shoulders so that the groove accommodating the elastic ring is formed by the lengthening and the two ring shoulders. On the spindle housing, the end-face cover is held by means of a flanged edge which is constructed on it and which reaches around the edge area of the end-face cover. In this are of the spindle housing, an upper bearing of the spindle shaft is arranged which is held in the axial direction by means of the end-face cover. Over a portion of its axial length in the radial direction, the elastic ring has a larger diameter than the sleeve-shaped end-face cover so that in this area a ring disk is formed which projects over the cover. On the interior wall of the wharve or the wharve bore, a collar is constructed which has a smaller diameter than the ring disk formed by the elastic ring. When the spindle top part is moved away from the spindle housing in the axial direction, the collar strikes against the ring disk. It is only under the effect of higher forces that the collar deforms the elastic ring such that the spindle top part can be pulled out of the spindle housing.

It is an object of the invention to provide an arrangement by means of which, particularly also in the case of spindles with a small diameter, a stable axial securing is achieved without any impairment of the safety of the bearing seat.

In order to achieve this object, it is suggested in the case of a spinning or twisting spindle of the initially mentioned type that the second retaining element is fastened to a sleeve which is fastened to the outer circumference of the spindle housing and projecting at its front or top end face.

By means of the arrangement according to the invention, it is achieved that the relative large forces which act upon the second retaining element assigned to the spindle housing do not have to be absorbed by the flange and the wall of the spindle housing which is weakened in this area anyhow. By means of the arrangement of the second retaining element on the sleeve, during the pulling-off of the spindle top part, essentially no forces are exercised on the wall of the spindle housing which is weakened in the area of the flange which may possibly lead to a loosening of the upper bearing ring and to a change of the overall bearing geometry. The sleeve, which is lengthened by way of the spindle housing, in the area in which the fastening of the second retaining element takes place, may be manufactured with a sufficient wall thickness while the width of the gap between the spindle shaft and the spindle housing is not important. As a result, the application of the axial securing arrangement according to the invention is also possible in the case of small spindles. Up to now, an internal securing arrangement has probably not been used for the above-mentioned space reasons.

In an advantageous development of the invention, the first retaining element is designed as a collar constructed on the interior wall of the wharve bore, and the second retaining element is constructed as an elastic ring fixed to the sleeve. In this case, the outside diameter of the elastic ring has a diameter that is larger than the inside diameter of the collar. When the spindle top part is pulled off the spindle housing, the elastic ring is deformed only when effected by a higher force in such a manner that the spindle top part can be moved away in the axial direction out of the spindle housing.

In a further development of the invention, it is provided that the elastic ring is accommodated by a ring groove which is inserted on the outer circumference of the sleeve in an area which, on its ends face, projects beyond the spindle housing. By means of this arrangement of the ring groove, it is achieved that, when the spindle top part is pulled off, the introduction of the force takes place into an area which is separated from the bearing seat of the upper bearing. Thus, when the spindle top part is pulled off, the bearing seat is not impaired. Furthermore, this arrangement permits a secure fixing of the elastic ring because, in this area of the sleeve, the ring groove can be manufactured with a sufficient wall thickness.

In order to permit a simple and cost-effective type of fastening of the sleeve, it may be provided that the sleeve is pressed onto the spindle housing. In addition or as an alternative, it may be provided that the sleeve is form-lockingly connected with the spindle housing. In this case, the spindle housing may have a ring groove which accommodates an assigned collar of the sleeve in a form-locking manner. The sleeve is expediently wedged over in a form-locking manner in the area of the ring groove. As a result, a further cost-effective and secure fastening of the sleeve is permitted.

In a further development of the invention, a ring-shaped gap may be provided in the area of the seat for an upper bearing of a spindle between the spindle housing and the sleeve, the gap being open in the direction of the end face of the spindle housing. Thus, a direct contact is avoided in the area of the bearing seat of the upper bearing. Even in the case of strong outside forces exercised on the internal securing arrangement, no deformation can therefore occur in the area of the upper bearing.

In a further development of the invention, it may be provided that the spindle housing has a collar on which the sleeve rests and which fixes it in the axial direction. A collar of this type which is arranged on the spindle housing mainly secures the sleeve in cases in which the spindle top part is introduced into the spindle housing.

Other objects, advantages and novel features of the present invention will become apparent from the following detailed description of the invention when considered in conjunction with the accompanying drawings.

DETAILED DESCRIPTION OF THE DRAWINGS

Figure 2:
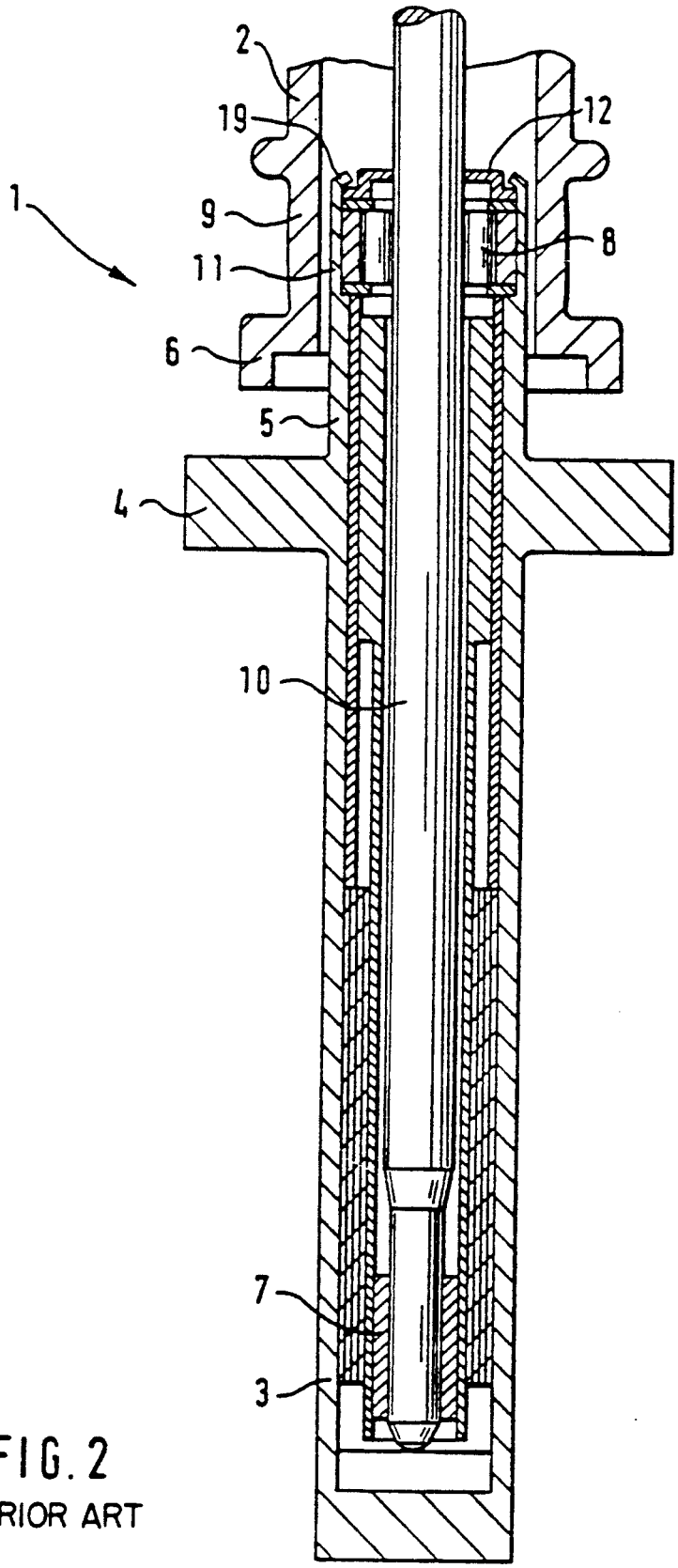
FIG. 2 PRIOR ART
FIG. 2 is a schematic longitudinal sectional representation of a conventional spindle.

FIG. 2 is a schematic representation of a conventional spindle 1 in which no internal securing arrangement is provided for a spindle top part 2. The spindle 1 comprises a spindle bottom part 3 and the spindle top part 2. The spindle bottom part 3 comprises the spindle housing 5 and is provided with a flange 4 by means of which it is fastened in a known manner to a spindle rail which is not shown and which is provided on one side of the spinning machine. The spindle housing 5 accommodates a shaft 10 of the spindle 1 which is rotatably disposed in a step bearing 7 and an upper bearing 8. The step bearing as well as the upper bearing 8 of the shaft 10 are accommodated in the spindle housing 5.

The spindle top part 2, which is shown only partially, comprises a wharve 9 against which a tangential belt rests which is not shown. A sleeve supporting part, which is not shown, connects to the wharve 9 in the upward direction for receiving a package tube. The part of the shaft 10 which projects out of the spindle housing 5 is non-rotatably connected with the wharve 9 and the sleeve supporting part.

On its end face, the wharve 9 ends with a flange 6. In the operating condition of the spindle 1, the tangential belt rests against the wharve 9 and sets the wharve 9 and, together with it, the sleeve supporting part and the shaft 10, into rotation.

The step bearing 7 is constructed as a slide bearing, and the upper bearing 8 is constructed as a roller bearing. In the area of the seat of the upper bearing 8, the wall 11 of the bearing housing 5 has a smaller thickness than the area following it in the direction of the step bearing 7. In the area of the upper end face of the spindle housing 5, the upper bearing 8 is covered by a ring-shaped cover 12 made of sheet metal. For the fastening of the cover 12, the spindle housing 5 is provided on its end face, is provided with a flanged edge 19 which reaches around the edge area of the cover 12. As a result, the seat of the upper bearing 8 is also secured in its axial direction. As further indicated in the representation, no internal securing arrangement is provided against an axial lifting-off of the spindle top part. Such a design is found particularly in the case of spindles 1 with a small diameter.

Figure 1:
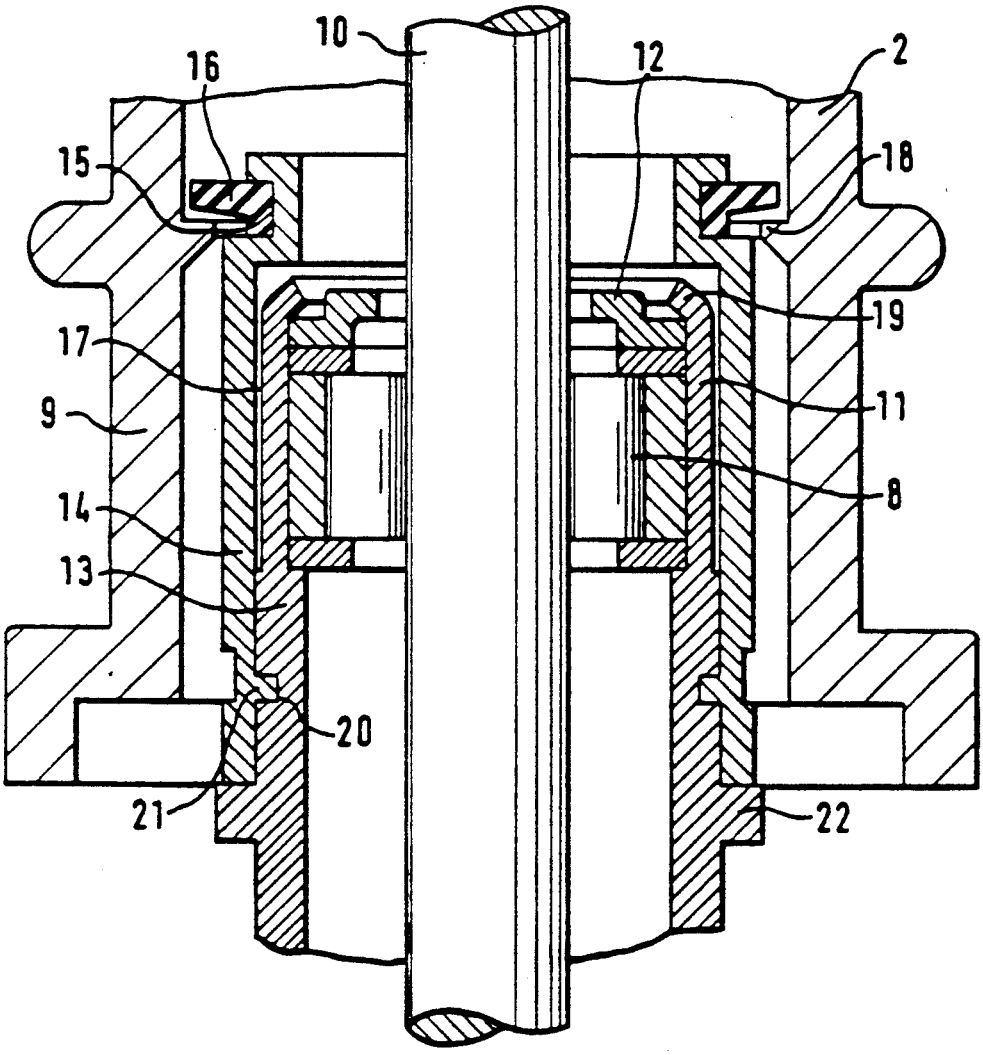
FIG. 1 is an enlarged schematic partial longitudinally sectional view of a spinning spindle constructed according to a preferred embodiment of the invention.

In contrast, the embodiment according to the invention illustrated in FIG. 1 has an internal securing arrangement for a spindle top part 2 which will be described in detail in the following. FIG. 1 is a very enlarged representation of the area of the upper bearing 8 of a spindle which, with the exception of the internal securing arrangement for the spindle top part described in the following, in principle, has the same construction as the conventional spindle illustrated in FIG. 2. The upper bearing 8 holding the shaft 10 is covered on its end face by a disk-shaped cover 12 made of sheet metal and is fixed in the axial direction with respect to a spindle housing 13. In the area of the seat of the upper bearing 8, the spindle housing 13 has a wall 11 with a smaller thickness. On the end face, the spindle housing 13 is provided with a flanged edge 19 which reaches around the edge area of the cover 12 and fixes the cover 12 as well as the upper bearing 8.

In the area of the upper bearing 8, the spindle housing 13 is surrounded by a sleeve 14 which projects beyond the spindle housing 13 in the axial direction. In the area of this end-face lengthening, the essentially cylindrical sleeve 14 is provided with a ring groove 15. Thus, the ring groove 15 is in an area of the sleeve 14 which, in the representation according to FIG. 1, is arranged above the spindle housing 13. By means of this arrangement, it is achieved that, in the area of the ring groove 15, the sleeve 14 can be constructed with approximately the same wall thickness as in the other areas. In the area of the ring groove 15, the sleeve 14 has a smaller inside diameter. The ring groove 15 receives an elastic ring 16 which may, for example, be made of Vulkollan. The elastic ring 16 has a larger outside diameter than the sleeve 14 and reaches almost to the interior wall of the wharve 9. On the interior wall of the wharve 9, a collar 18 is formed which, in the installed condition of the spindle top part 9, is positioned to be slightly offset in the axial direction with respect to the elastic ring 16. As indicated in FIG. 1, the inside diameter of the collar 18 is smaller than the outside diameter of the elastic ring 16.

A ring groove 20 is machined into the exterior wall of the spindle housing 13 at a distance from the area of the upper bearing 8. An assigned collar 21 of the sleeve 14 projects into this ring groove 20 while forming a form closure. The sleeve 14 is pressed onto the outer circumference of the spindle housing 13 and is additionally form-lockingly wedged over in the area of the ring groove 20 and of the collar 21. The lower end face of the sleeve 14, which is on the bottom in the drawing, rests against a collar 22 provided on the spindle housing 13.

As illustrated in the drawing, in the area of the seat of the upper bearing 8, the sleeve 14 no longer rests against the outer circumference of the spindle housing 13. On the contrary, a ring-shaped gap 17 which is open in the direction of the top end face of the spindle housing 13, is bounded by the wall 11 and the sleeve 14. Thus, in the area of the upper bearing 8, no forces can be transmitted by the sleeve 14 which may possibly have negative effects on the bearing seat.

When the top part 9 of the spindle is moved upward in the axial direction, the collar 18 of the wharve 9 first comes to rest against the elastic ring 16. In the case of low axial forces, the spindle top part is therefore secured in the axial direction by means of this internal securing arrangement. When the axial force is increased, the elastic ring 16 is deflected so that the collar 18 can pass by it in a glancing manner. The forces which effect the sleeve 14 in this case, because of the arrangement of the elastic ring 16 according to the invention, affect neither the end face nor the shell side of the bearing seat. On the contrary, they are entered into the spindle housing in an area of the spindle housing that is arranged below the upper bearing 8, because the sleeve 14 is fixed to the spindle housing 13 in this area. Thus, no forces occur in the area of the upper bearing 8 Which may possibly have negative effects on the bearing seat.

When the top part of the spindle is inserted into the spindle housing 13, the collar 18 also comes in contact with the elastic ring 16 and can overcome it independently of the introduced forces. Also in this case, no disturbing forces occur in the area of the bearing seat of the upper bearing 8. On the contrary, also the forces transmitted to the sleeve 14 are introduced in the area of the ring groove 20 and the collar 22 into the spindle housing 13. For facilitating the fitting-on of the spindle top part, the collar provided on the interior wall of the wharve 9 has an oblique construction on its bottom side.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A spinning or twisting spindle assembly for securing a spindle top part in an axial direction against a lifting out from a spindle housing using a first retaining element arranged on an interior wall of a wharve bore and which forms a detachable closure with a second retaining element that is arranged on an upper front end of the spindle housing, the assembly comprising:

a spindle housing, an upper spindle bearing for rotatably supporting a spindle shaft, said upper spindle bearing being supported inside said spindle housing adjacent an upper end of said spindle housing, a spindle top part which includes a belt driving wharve which surrounds a wharve bore in the spindle top part, said spindle top part being disposed with its wharve bore surrounding the upper end of the spindle housing when in an operative position, a retainer support sleeve fastened to an outer circumference of the spindle housing and projecting with an upper retainer support sleeve section above the spindle housing and concentrically surrounding the upper end of the spindle housing, a first retaining element disposed in the wharve bore on the spindle top part, and a second retaining element carried by the upper retainer support sleeve section, at least one of said first and second retaining elements being radially deflectable, said first and second retaining elements being engageable with one another to preclude upward movement of the spindle top part during spinning or twisting operation while permitting an intentional lifting off of the spindle top part with radial deflection of at least one of the first and second retaining elements.

2. A spinning or twisting spindle assembly according to claim 1, wherein the first retaining element is designed as a collar constructed on the interior wall of the wharve bore and the second retaining element is designed as an elastic ring fixed to the retainer support sleeve.

3. A spinning or twisting spindle assembly according to claim 2, wherein the elastic ring is received by a ring groove which is inserted on an outer circumference of the retainer support sleeve in an area projecting beyond a top end face of the spindle housing.

4. A spinning or twisting spindle assembly according to claim 3, wherein the retainer support sleeve is pressed onto the spindle housing.

5. A spinning or twisting spindle assembly according to claim 4, wherein the retainer support sleeve has a collar and the spindle housing has a ring groove which accommodates the collar of the retainer support sleeve in a formlocking manner.

6. A spinning or twisting spindle assembly according to claim 5, wherein a ring-shaped gap is provided which is open in the direction of the top end of the spindle housing in the area of a seat for the upper bearing of a spindle between the spindle housing and the retainer support sleeve.

7. A spinning or twisting spindle assembly according to claim 6, wherein the spindle housing has a collar against which the retainer support sleeve rest and fixes it in the axial direction.

8. A spinning or twisting spindle assembly according to claim 7, wherein said retainer support sleeve is radially spaced from the spindle housing along an axial length which accommodates the upper bearing.

9. A spinning or twisting spindle assembly according to claim 4, wherein said retainer support sleeve is radially spaced from the spindle housing along an axial length which accommodates the upper bearing.

10. A spinning or twisting spindle assembly according to claim 1, wherein the retainer support sleeve is pressed onto the spindle housing.

11. A spinning or twisting spindle assembly according to claim 1, wherein the retainer support sleeve is formlockingly connected with the spindle housing.

12. A spinning or twisting spindle assembly according to claim 11, wherein the retainer support sleeve has a collar and the spindle housing has a ring groove which accommodates the collar of the retainer support sleeve in a formlocking manner.

13. A spinning or twisting spindle assembly according to claim 1, wherein a ring-shaped gap is provided which is open in the direction of the top end of the spindle housing in the area of a seat for the upper bearing of a spindle between the spindle housing and the retainer support sleeve.

14. A spinning or twisting spindle assembly according to claim 1, wherein the spindle housing has a collar against which the retainer support sleeve rests and fixes it in the axial direction.

15. A spinning or twisting spindle assembly according to claim 1, wherein said retainer support sleeve is radially spaced from the spindle housing along an axial length which accommodates the upper housing.

* * * * *